US005161282A

United States Patent [19]

Pechota, Jr.

[11] Patent Number: 5,161,282

[45] Date of Patent: Nov. 10, 1992

[54] DOOR STOP

[76] Inventor: Frank Pechota, Jr., Box 222, Colome, S. Dak. 57528

[21] Appl. No.: 740,494

[22] Filed: Aug. 5, 1991

[51] Int. Cl.[5] ..... E05F 5/06

[52] U.S. Cl. ..... 16/86 A; 16/85

[58] Field of Search ..... 16/86 R, 86 A, 82, 85

[56] References Cited

U.S. PATENT DOCUMENTS

| | | | |
|---|---|---|---|
| 132,046 | 10/1972 | Bird | 16/85 |
| 356,115 | 1/1987 | Frothingham | 16/86 A |
| 1,044,412 | 11/1912 | Newton | 16/85 |
| 1,898,562 | 2/1933 | More | 16/82 |
| 2,063,526 | 12/1936 | Snowden | 16/49 |
| 2,237,148 | 4/1941 | Kaptuller | 16/86 A |
| 2,295,496 | 9/1942 | Cameron | 16/78 |
| 3,042,959 | 7/1962 | Strom | 16/86 |
| 4,209,150 | 6/1980 | Stephenson | 16/82 |

*Primary Examiner*—John Sipos
*Assistant Examiner*—Carmine Cuda

[57] ABSTRACT

A door stop for attachment to the top of a door frame. The stop is held at a permanent angle by ornamental bracing. The door stop may be used for either right or left hand doors, and is buffered so that the impact of a fast opening door will be damped.

4 Claims, 1 Drawing Sheet

DOOR STOP

BACKGROUND AND SUMMARY OF THE INVENTION

This invention pertains to door stops and more particularly to a stop for an exterior screen door or storm door. Such doors are frequently subject to near violent opening in windy climates where the wind may suddenly catch the door either unlatched or being opened. When this happens while someone is opening the door, it is not uncommon for the wind to pull the door from a person's hand and slam it violently against a wall, jerking chains or other restraints to the breaking or bending point, occasionally pulling hinges loose or doing other damage.

There have been several devives used in an effect to minimize the damage. Chains or springs between the door and the door jamb adjacent the hinge are frequently used. Hydraulically damped dooor closers having a small single piston and engaged between the door and the jamb carrying the hinges are also common. However, all of these devices have shortcomings. Both the chains and the door closers are customarily fastened to the door jamb by screw devices. Since much of the force pulls directly on the head of the screws, there is a tendency for them to pull out of the wood. It is not at all unusual to have the piston rod of the door closer be bent so that it cannot be used again.

By my invention, I provide a door stop readily reversible so it can be used with either right-hand or left-hand doors. The multiple fastenings are numerous enough that the force is spread among them making failure less likely. The device is also readily reversible so that it can be used on doors opening from either the right or left side.

DESCRIPTION

Figure 1:
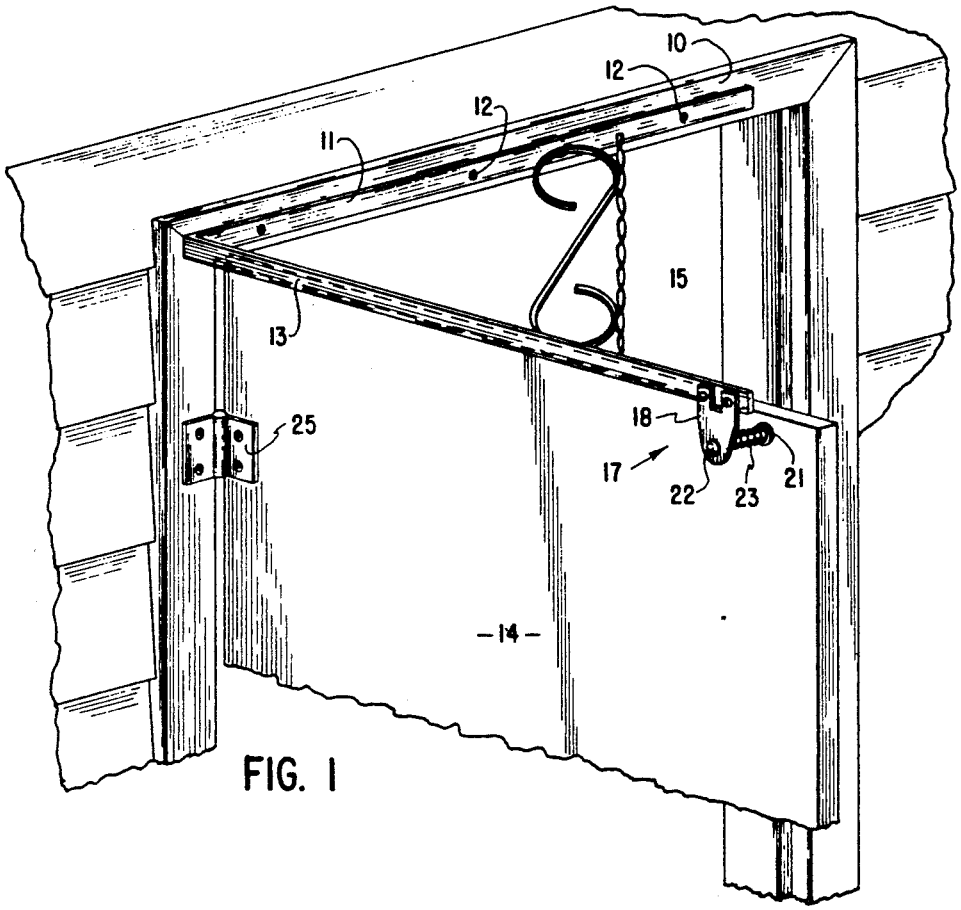
FIG. 1 is a perspective view of the door stop in place on an exterior door.
Figure 2:
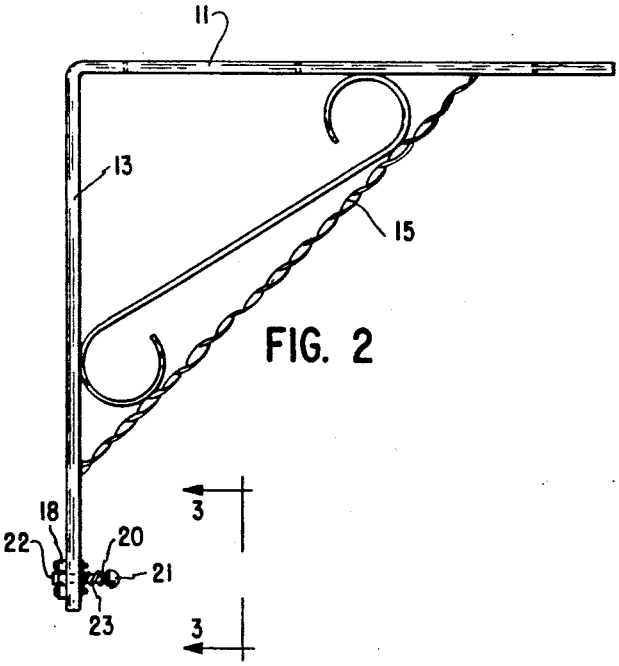
FIG. 2 is a top plan view of the door stop.
Figure 3:
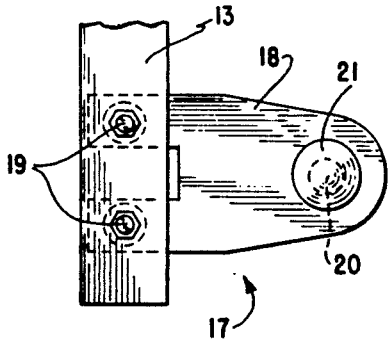
FIG. 3 is a detailed view to an enlarged scale from line 3—3 of FIG. 2.

Briefly my invention comprises a door stop adapted to be fixed to a door frame of a door opening from either the right or left side and having a device for damping the impact of a wind-blown door.

More specifically and referring to the drawings, the device is adapted to be fastened to the upper part 10 of the door frame above the door, preferably of running screws into the header. The stop itself consists of an angle-shaped bracket having two legs; a fastening leg 11 having holes for screws 12 by which it is attached to the leader 10, and a resisting leg 13. These legs form an angle which is illustrated as approximately 90° but may be somewhat larger so as to allow a slightly fuller opening of the door 14.

The legs 11 and 13 are held in their relative angular position by a brace 15 which may be ornamental, and is illustrated as having two parts though that form is not necessary to the invention.

At its outer end, the resisting leg 13 carries a snubber 17 consisting of a plate 18 fixed to the leg 13 by means of bolts or machine screws 19. This plate carries a slidable device consisting of a bar 20 slidably journalled in the plate 18 in a direction substantially perpendicular to the plate. At one end, the bar 20 is provided with a rubber bumper 21. At its other end, the bar has an enlarged burr 22 which keeps it from being pulled out of the plate 18. A compression spring 23 engaged between the plate 18 and the bumper 21 biasses the device against any impact of the door 14 against the bumper 21 as the door is opened.

It will be seen that bolting the snubber mechanism 17 to the arm 13 makes it easily possible to remove the snubber. Then, by bolting the snubber to extend in the opposite direction from the arm 13 and inverting the entire device, it can be shifted from use on a door opening from one side to a door opening from the opposite side. Therefore, my device is readily usable regardless of the direction of opening of the door.

It will also be apparent that when the door stop is securely in place, any sudden opening of the door, whether by wind or other force, will be effectively snubbed and damped by the impact of the door collapsing the spring 23 and by the added resilience of the rubber bumper 21. This snubbing of the door reduces strain on the hinges 25 and other parts of the door.

I claim as my invention:

1. A door stop for snubbing the violent opening of a door mounted on a frame, said frame having an overhead rail, said door stop comprising a unitary angle-shaped piece having two legs, a first of said two legs comprising fastening means fixed to said rail, a second of said two legs comprising resisting means and being held in fixed angular relationship to said fastening means, snubber means removably fastened to said resisting means whereby said door stop can be adapted to both right-hand and left-hand opening doors, said snubber means including a plate removably fastened to said resisting means, bar means slidably mounted in said plate and biassing means tending to hold said bar means in the direction opposite to the direction of opening of said door.

2. The door stop of claim 1 in which a brace connected between said legs holds the legs in fixed angular position.

3. The door stop of claim 1 in which said biassing means is a compression spring surrounding said bar means, said bar means having a bumper end, said spring being engaged between said bumper end and said plate.

4. The door stop of claim 3 in which said bumper end includes a resilient pad adapted to receive the impact from said door.

* * * * *